United States Patent [19]

Blach et al.

[11] Patent Number: 4,794,486

[45] Date of Patent: Dec. 27, 1988

[54] APPARATUS FOR THE IONIZATION OF GASEOUS OXYGEN

[75] Inventors: Thomas Blach, Ruschwedel-Harsefeld; Wolfgang Wichern, Muhlendamm, both of Fed. Rep. of Germany

[73] Assignee: Biomed-Electronic GmbH & Co., Buxtehude, Fed. Rep. of Germany

[21] Appl. No.: 32,581

[22] Filed: Apr. 1, 1987

[30] Foreign Application Priority Data

Apr. 2, 1986 [DE] Fed. Rep. of Germany ... 8608913[U]
May 2, 1986 [DE] Fed. Rep. of Germany ..... 3614994
Jan. 27, 1987 [DE] Fed. Rep. of Germany ..... 3702337

[51] Int. Cl.[4] ..... H01T 23/00
[52] U.S. Cl. ..... 361/231
[58] Field of Search ..... 361/229, 230, 231, 235, 361/213; 55/131, 129, 103, 105, 139; 128/202.25

[56] References Cited

U.S. PATENT DOCUMENTS 3,996,474 10/1975 Lowther ..... 422/186.07
4,344,776 8/1982 Yavnieli ..... 55/129
4,662,903 5/1987 Yanagawa ..... 55/131 X
4,675,781 6/1987 Saurenman ..... 361/230 X

*Primary Examiner*—L. T. Hix
*Assistant Examiner*—D. Rutledge
*Attorney, Agent, or Firm*—Browdy and Neimark

[57] ABSTRACT

An apparatus for the ionization of gaseous oxygen, especially of oxygen in room air, for providing ionization air free of harmful substances and with a neutral charge. The device has a housing (1) preferably of an insulating material, with an inlet opening (6) and an outlet opening (7) for the oxygen or air and with an anode (10) and a cathode (11) disposed in the housing (1). Preferably the anode (10) and the cathode (11) are electrode wires extending crosswise to the direction of flow, preferably of copper with a coat of enamel. Ionization takes place free of harmful substances and electrostatic charges are eliminated as a result of providing two separate flow paths (12, 13) between the inlet opening (5) and the outlet opening (6), the anode (10) being disposed in one flow path (12) and the cathode (11) is disposed in the second flow path (13), and a backplate electrode (14), preferably common to both flow paths (12, 13) and placed at ground potential, being associated with both flow paths (12, 13).

18 Claims, 3 Drawing Sheets

APPARATUS FOR THE IONIZATION OF GASEOUS OXYGEN

BACKGROUND OF THE INVENTION

1. Field of the Invention

The invention relates to an apparatus for the ionization of gaseous oxygen, especially of oxygen in room air, having a housing preferably consisting of an insulating material, especially PVC, with an inlet opening and an outlet opening for the oxygen or air, and with an anode and a cathode disposed in the housing. The anode and the cathode can be in the form of electrode wires extendig crosswise to the direction of flow, and can be copper and provided with a coat of enamel.

2. The Prior art

Known devices (as in German Laid-Open Application No. DE-OS 34 11 335) permit the achievement of very high ion concentrations or corresponding charged particle concentrations without the formation of ozone. This prior art also prevents the formation of further harmful substances, such as for example nitrogen oxides. Based on the specialized disposition and construction of the anodes and cathode of the known apparatus, the interaction of the oxygen molecules, either in pure oxygen or in the oxygen of the air, is just intense enough to make ionization possible, but not sufficient to make possible the formation of active oxygen as a precondition for the formation of ozone.

The known apparatus above for the ionization of gaseous oxygen is especially designed for medical use. In this field a high positive ionization of the medical oxygen is of importance. Therefore it is only possible with the known apparatus to realize either a positive or a negative ionization of the air or oxygen flowing out of the outlet.

Ionization apparatuses for the ionization of room air having larger volumes are generally known (as in German Published Application No. DE-AS 25 45 905). These generally operate with relatively low ion concentrations in the outflowing room air. Also in this prior art, positively ionized or negatively ionized room air can be obtained, depending on whether the anode is placed downstream from the cathode or upstream from the cathode in the direction of flow. In this as well as in the known apparatus further above, on which the invention is based, electrostatic charges in a room can only be eliminated if they accidentally have polarity opposite that of the ionization polarity. Otherwise these charges are possibly even increased.

SUMMARY OF THE INVENTION

It is an object of the invention to define an apparatus for the ionization of gaseous oxygen, especially of oxygen in room air, by means of which ionization can be obtained free of harmful substances and with a neutral charge, and wherein electrostatic charges can always be eliminated.

The apparatus of the invention for attaining the object described above is first characterized by the formation of two separate flow paths in the housing between the inlet opening and the outlet opening, in that the anode is disposed in a first one of the flow paths and the cathode is disposed in the second flow path, and in that a backplate electrode, preferably a backplate electrode common to both flow paths, especially a backplate electrode placed at ground potential, is associated with both flow paths, preferably at the beginning (or at the end) of the flow paths. Thus it is fundamental that with the apparatus of the present invention polar ionization can be performed, i.e. negative and positive ionization can be provided at the same time. This can be done without the creation of harmful substances as in the known devices. In both flow paths, small ions settle on the small dirt particles present in the room air. Following this, large ions are formed as well, and these are electrically neutralized after emerging from the outlet opening because of the mixing of negative and positive potentials, so that at the end a potential free, ideal climate is obtained in the room. At the same time electrostatic charges are also eliminated regardless of their polarity.

DESCRIPTION OF THE PREFERRED EMBODIMENTS

Figure 1:
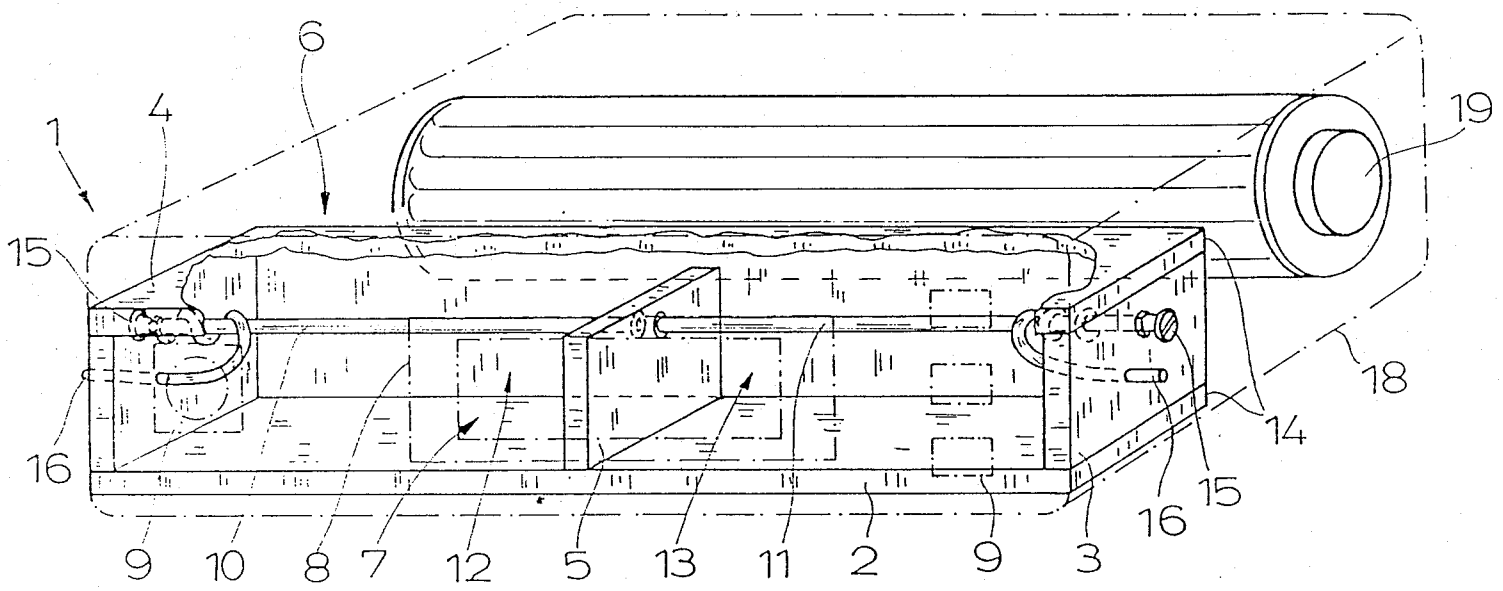
FIG. 1 shows schematically a first embodiment of an apparatus according to the invention, in a prespective, partially cut-open view.

The first exemplary embodiment of an apparatus of the invention for the ionization of gaseous oxygen, especially of oxygen in room air, is shown in FIG. 1 to have a housing 1 preferably consisting of an insulating material, especially of PVC. In the exemplary embodiment here described, the housing 1 has a bottom 2, two side walls 3 disposed essentially parallel to each other, and as well a ceiling 4 opposite the bottom. A partition 5 is located parallel to the side walls, approximately in the center of the housing 1, also consisting of an insulating material, especially of PVC. The function of this configuration is further described below. The ceiling 4 is partially cut open in order to show the interior of the housing 1.

The housing 1 has an inlet opening 6 in a back end as shown in FIG. 1. The inlet opening 6 may be disposed on a rear wall of the housing 1, however the inlet opening can be provided simply by the housing 1 being open at the back in order for the oxygen or the air to enter to be ionized. Opposite the inlet opening 6, at a front end as shown in FIG. 1, an outlet opening 7 is located for the oxygen or the air to exit. The outlet opening 7 is disposed (shown by dash-dotted lines), in a front wall 8 (also shown by dot-dashed lines) of the housing 1. A number of operating elements 9 (shown by dot-dashed lines) may be provided in this front wall 8, which have no particular importance for the teachings of the invention and therefore need not be described further.

In the cut-open view through the ceiling 4, an anode 10 and a cathode 11 are seen to be disposed in the housing 1. The anode 10 and cathode 11 may be formed as shown, namely as electrode wires extending crosswise to the direction of flow. The electrode wires can be of copper and provided with a coat of enamel.

According to the present invention, two separate flow paths 12, 13 are provided in the housing 1 between the inlet opening 6 and the outlet opening 7, the anode 10 is disposed in a first flow path 12 and the cathode 11 in the second flow path 13. In both flow paths 12, 13, preferably at the beginning (or end) of the flow paths 12, 13, an associated backplate electrode 14 is disposed. The backplate electrode 14 can be common to both flow paths 12, 13, and the backplate electrode 14 can be placed at ground potential. In the exemplary embodiment shown in FIG. 1, the backplate electrode 14 is located at the beginning of the flow paths 12, 13, i.e. on the inlet opening 6 of the housing 1. However, the backplate electrode 14 can also be disposed in an entirely different way, as further explained.

The exemplary embodiment of FIG. 1 has the anode 10 and the cathode 11 disposed adjacent to each other in the flow paths, preferably in alignment. The flow paths 12, 13 therefore are located adjacent to each other, and the inlet opening 6 for both flow paths 12, 13 can be accordingly oblong and rectangular. This results in an especially smooth flow of the air and, accordingly, an especially even and optimal ionization.

In FIG. 1 the anode 10 and the cathode 11 are inserted into the housing 1 of insulating material. They are secured therein by fastening screws 15. The housing 1 can also be made of metal, in which case the housing 1 then could provide the backplate electrode, and the fastening elements for the anode 10 and the cathode 11 would then have to be made of an insulating material to assure insulating from the housing 1. Correspondingly, the same holds true for the partition 5 of the housing 1 which, in the exemplary embodiment shown in FIG. 1, simultaneously forms the support for the free ends of the anode 10 and the cathode 11.

Voltage can be supplied to the anode 10 and the cathode 11 via the fastening screws 15. However, it has been shown that the field thus generated between either of the anode 10 or the cathode 11 and the backplate electrode 14 is too homogeneous, so that the ionization process is hard to start. A further teaching of the present invention is that the voltage supply for the anode 10 and/or the cathode 11 takes place via a supply wire 16 or the like. The supply wire 16 enters the housing 1 at the side of the anode 10 or the cathode 11, and is connected at a certain distance from the housing wall to the anode 10 or the cathode 11. The supply wire 16 may be preferably wound on the anode 10 or the cathode 11 all the way back to the housing wall. By means of this construction, a homogeneous field is established on the voltage supply side, and is exactly defined by the size, shape and position of the supply wire 16 or the like. This makes the start of ionization easier. This feature of the present invention can also be used when the apparatus for the ionization only has one flow path with anodes and cathodes placed one behind the other.

As explained above, in the exemplary embodiment shown in FIG. 1, the inlet opening 6 and the outlet opening 7 are made oblong and of approximately rectangular shape. In accordance with a further feature of the present invention as shown in FIG. 1, the backplate electrode 14 can be a frame of electrically conductive material surrounding the inlet opening 6 or the outlet opening 7. In this way an especially homogeneous, evenly distributed field strength of the electric field between either the anode 10 or the cathode 11 and the backplate electrode 14 can be achieved, especially with an oblong and approximately rectangular construction of the inlet opening 6 and side-by-side flow paths 12, 13 as in FIG. 1.

Figure 2:
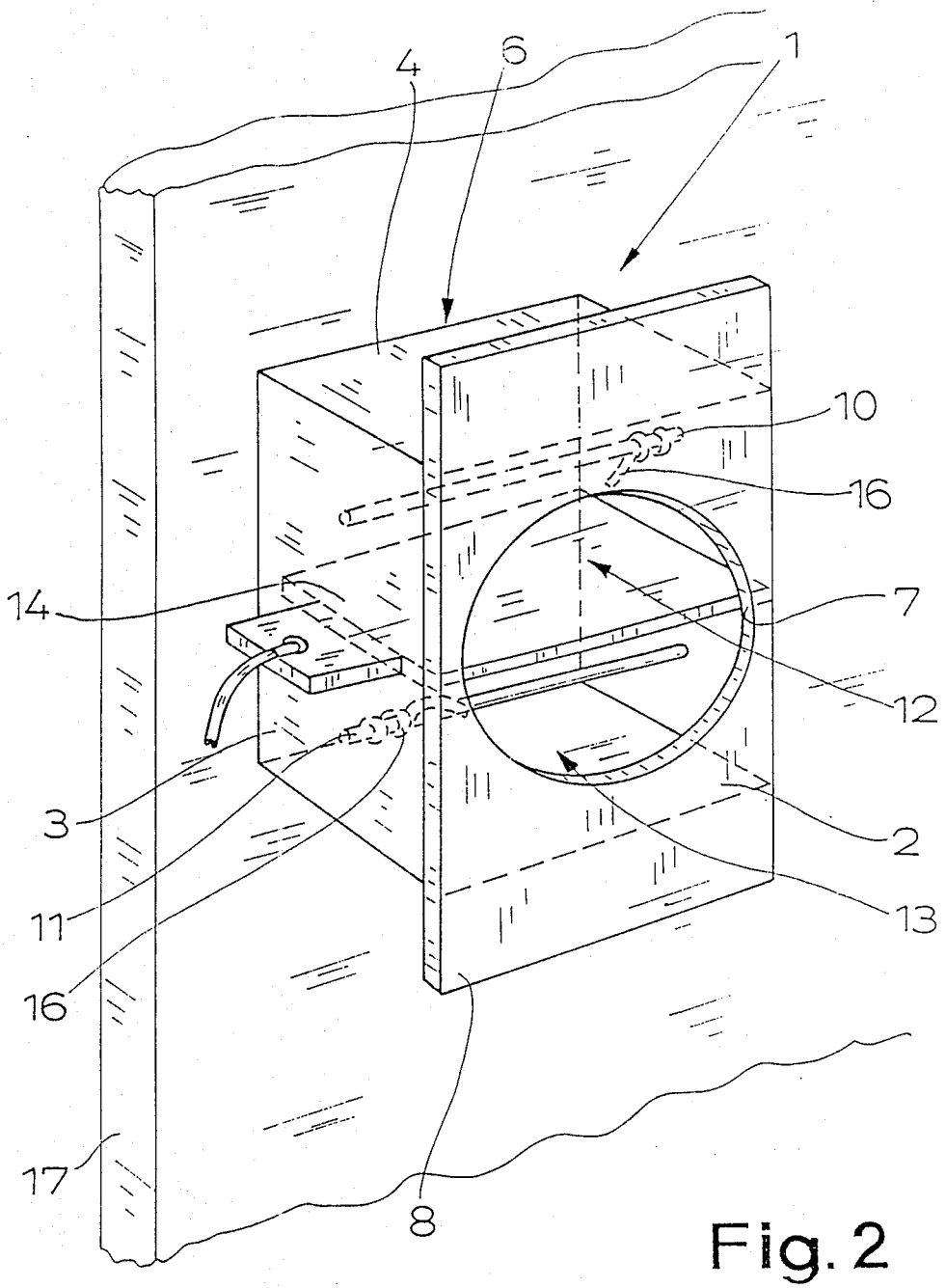
FIG. 2 similarly shows a further embodiment of an apparatus according to the invention similar to FIG. 1.

FIG. 2 shows a further exemplary embodiment of an apparatus in accordance with the present invention, which is especially suited and designed for application at the outlet opening of a ventilation system. For example, it can be inserted into the wall 17 of a building at the outlet of a conduit of an air-conditioning system. This apparatus is not further described to the extent that it coincides with the apparatus of FIG. 1, for instance as indicated by the identical reference numerals. However, it is significant in this apparatus that the anode 10 and the cathode 11 here are located side by side, that is, parallel to each other. The two parallel flow paths, 12 for the anode 10 and 13 for the cathode 11, are not disposed here adjacent each other as in FIG. 1, but are oriented in parallel next to each other or on top of each other. Basically, however, this does not lead to diminished results. Furthermore, here the backplate electrode is provided in the form of a partition in the housing 1, separating the two flow paths 12, 13. Therefore, the backplate 14 in this case takes on an electrical function in addition to the mechanical function of the partition 5 in the exemplary embodiment according to FIG. 1.

Returning to FIG. 1, it can be seen that the exemplary embodiment shown here provides an apparaus which can be used for the ionization of gaseous oxygen, that is, independent from an external air flow. Additionally, a blower housing 18 can be attached to the housing 1 at the inlet side, as indicated by dot-dashed lines. In this exemplary embodiment, in accordance with a preferred teaching of the invention, a tangential circulating blower 19 is disposed in the blower housing 18. Such a tangential circulating blower 19 provides in an especially practical way the flow paths 12, 13, disposed in a flat manner next to each other, with the oblong, rectangular inlet opening 6 in the housing 1. However, other types of blowers of conventional construction can also be used. FIG. 1 shows that the blower housing 18 extends beyond the front of the housing 1 of the actual apparatus for ionization, since the height of the blower housing 18 is somewhat greater in the exemplary embodiment shown here than the height of the housing 1 by reason of the construction of the tangential circulating blower 19. However, this is of importance merely for reasons of structure and design.

The blower housing 18 of the exemplary embodiment shown in FIG. 1 offers a special opportunity to integrate the backplate electrode 14. It is possible to form the backplate electrode 14 of an electrically conductive material so as to constitute the edge of the blower housing 18, surrounding the inlet opening 6. If, as is often the case, the blower housing 18 is made totally of metal, the function of the backplate electrode 14 can be easily provided by the edge of the housing 18 adjoining the inlet opening 6 being simply grounded.

To achieve a result of even ionization, it is practical if a static overpressure exists in the interior of the housing 1, preferably an overpressure of at least 10 mbar. This can be achieved by a corresponding structure or disposition of the outlet opening 7 in the housing 1. It is especially recommended to provide the outlet opening 7 with a backpressure insert (not shown in the drawings), which can be in the form of a screen, web, sponge or the like. Taking into account the given conditions at the edge, many different materials can be found. If the backpressure insert is a web of metallic material, for example a screen, it is recommended that the outlet opening 7, and especially the overpressure insert itself, be placed at ground potential. This is advantageous to assure that no interference potential is created at the outlet opening 7 or at the backpressure insert itself.

Figure 3:
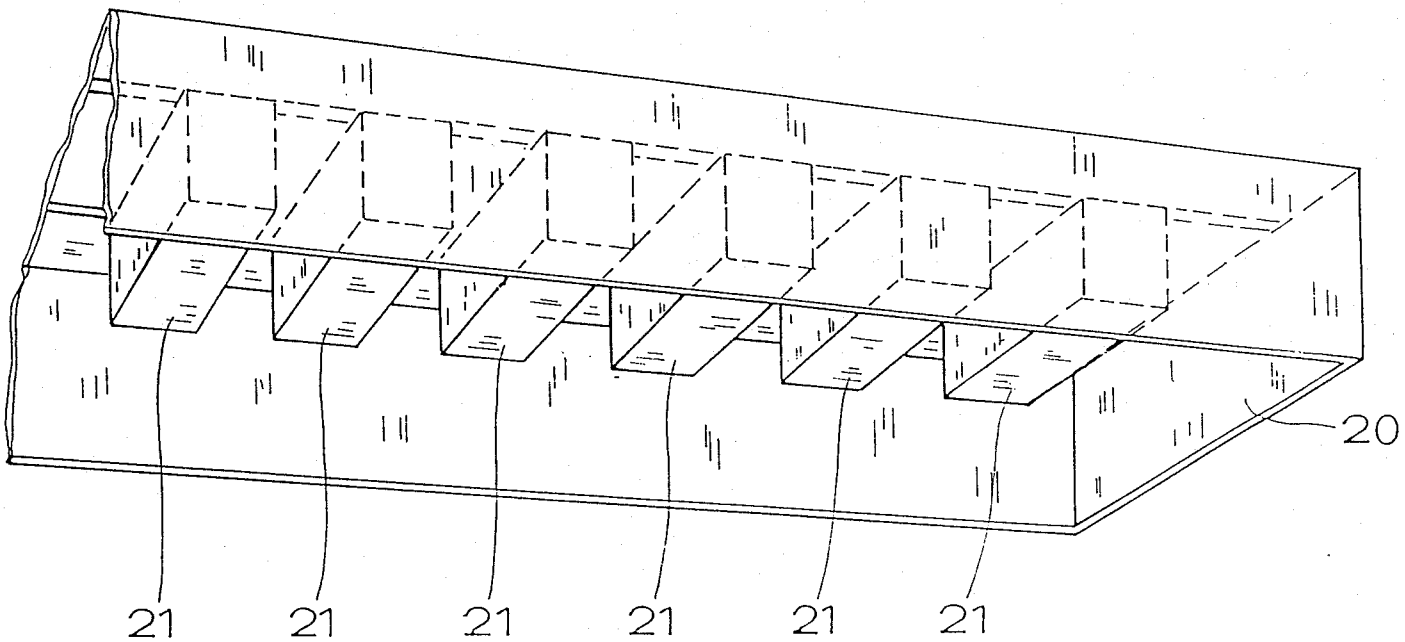
FIG. 3 shows a third embodiment of an apparatus according to an apparatus of the invention, namely in the form of an ionization system with a large surface area.

FIG. 3 shows an entire ionization system for an air outlet opening 20 having an especially large surface area, such as for large, air-conditioned conference rooms. This ionization system is characterized in that a plurality of apparatuses for the ionization of gaseous oxygen, especially of oxygen in room air are disposed next to each other but at a distance from each other. Each of these apparatuses 21 can be a complete apparatus of the type described above wherein each emits at its two outlets airstreams having positive and negative charges. Test have shown that it is sufficient to achieve charge neutrality with such an ionization system if the apparatuses 21 are constructed or connected such that the emerging airstream is alternately enriched with positively and negatively charge carriers.

It is to be understood that the invention is not limited to the exemplary embodiments described above, and that other embodiments and improvements are possible within the scope of the invention.

What is claimed is:

1. An apparatus for the ionization of oxygen gas in room air, comprising:

a housing of an insulating material, with an inlet opening and an outlet opening for the air;

an anode and a cathode disposed in the housing and being respective electrode wires extending crosswise to the direction of flow of the air;

two separate flow paths between the inlet opening and the outlet opening, the anode being disposed in a first one of the flow paths for providing positive ionization and the cathode being disposed in the second flow path for providing negative ionization; and a backplate electrode commonly associated with both flow paths and being at ground potential;

wherein the backplate electrode is a frame of electrically conducting material surrounding either said inlet opening or said outlet opening.

2. An apparatus in accordance with claim 1, wherein the inlet opening and the outlet opening are oblong and formed to be approximately rectangular.

3. An apparatus in accordance with claim 1, comprising a blower housing on the inlet side of said housing.

4. An apparatus in accordance with claim 3, comprising a tangential circulating blower provided in said blower housing, and wherein said backplate electrode has a frame of an electrically conducting material that surrounds said inlet opening.

5. An apparatus is accordance with claim 1, said electrode wires being of copper.

6. An apparatus in accordance with claim 5, said copper electrode wires being coated with enamel.

7. An apparatus in accordance with claim 1, comprising a respective voltage supply wire for each of the anode and cathode, each entering the housing at the side of the respective one of the anode and cathode, and being connected at a certain distance from the housing wall to the respective one of the anode and cathode.

8. An apparatus in accordance with claim 7, wherein each said voltage supply wire is wound on the respective one of the anode and cathode from where it is connected thereto back to a respective wall of said housing.

9. An apparatus in accordance with claim 1, wherein the outlet opening is provided so as to result in a slight overpressure of said gas in the interior of the housing.

10. An apparatus in accordance with claim 9, said outlet opening comprising a backpressure insert on the interior of said housing to provide said overpressure to be at least 10 mbar, wherein said backpressure insert is of a conductive material and is connected to ground.

11. An apparatus for the ionization of oxygen gas in room air, comprising:

a housing of an insulating material, with an inlet opening and an outlet opening for the air;

an anode and a cathode disposed in the housing and being respective electrode wires extending crosswise to the direction of flow of the air;

two separate flow paths between the inlet opening and the outlet opening, the anode being disposed in a first one of the flow paths for providing positive ionization and the cathode being disposed in the second flow path for providing negative ionization; and a backplate electrode commonly associated with both flow paths and being at ground potential;

wherein the backplate electrode is a partition in the housing separating the two flow paths;

said anode and cathode being aligned in parallel with each other.

12. An apparatus in accordance with claim 11, comprising a blower housing on the inlet side of said housing.

13. An apparatus in accordance with claim 11, said electrode wires being of copper.

14. An apparatus in accordance with claim 13, said copper electrode wires being coated with enamel.

15. An apparatus in accordance with claim 11, comprising a respective voltage supply wire for each of the anode and cathode, each entering the housing at the side of the respective one of the anode and cathode, and being connected at a certain distance from the housing wall to the respective one of the anode and cathode.

16. An apparatus in accordance with claim 15, wherein each said voltage supply wire is wound on the respective one of the anode and cathode from where it is connected thereto back to a respective wall of said housing.

17. An apparatus in accordance with claim 11, wherein the outlet opening is provided so as to result in a slight overpressure of said gas in the interior of the housing.

18. An apparatus in accordance with claim 17, said outlet opening comprising a backpressure insert on the interior of said housing to provide said overpressure to be at least 10 mbar, wherein said backpressure insert is of a conductive material and is connected to ground.

* * * * *